US006397389B1

(12) United States Patent
Schultz

(10) Patent No.: US 6,397,389 B1
(45) Date of Patent: Jun. 4, 2002

(54) CHILD WALKING HARNESS

(76) Inventor: Nils C. Schultz, 7527 Cabrillo Ave., La Jolla, CA (US) 92037

( * ) Notice: Subject to any disclaimer, the term of this patent is extended or adjusted under 35 U.S.C. 154(b) by 0 days.

(21) Appl. No.: 09/818,613

(22) Filed: Mar. 28, 2001

(51) Int. Cl.[7] ..... A62B 35/00; B68B 1/00

(52) U.S. Cl. ..... 2/69; 182/3; 128/875; 119/907; 54/71

(58) Field of Search ..... 2/69, 94, 108, 2/79, 69.5, 83, 44, 45, 102, 327; 182/3–4, 6; 244/151 R, 142–143; 128/869, 875; 119/857, 907, 769, 770; 54/71, 79.1

(56) References Cited

U.S. PATENT DOCUMENTS 1,651,561 A * 12/1927 Storey ..... 119/770
3,701,395 A * 10/1972 Theobald ..... 182/3
3,997,921 A * 12/1976 Knight ..... 2/75
4,537,154 A 8/1985 Kay
4,745,926 A * 5/1988 Hlusko ..... 128/134
4,922,860 A 5/1990 Hutchings
5,220,976 A * 6/1993 Gunter ..... 182/3
5,495,621 A * 3/1996 Kibbee ..... 2/2.5
5,676,426 A 10/1997 Herring
5,692,456 A 12/1997 Louks-Phillips
5,927,235 A 7/1999 Olaiz
5,967,145 A * 10/1999 Knapik et al. ..... 128/869
6,009,839 A 1/2000 Kohn
6,101,631 A * 8/2000 Ferguson ..... 2/94

* cited by examiner

*Primary Examiner*—John J. Calvert
*Assistant Examiner*—Tejash Patel

(57) ABSTRACT

A child walking harness made of flexible material comprising a front and rear body panel which are connected through the legs of the child at the crotch portion. The front and rear body panels are provided panel extensions that connect to each other by means of hook and loop fasteners attached to each end thereof. The upper portion of the body panels are provided with shoulder straps which are fitted with releasable securing devices which lock together over the child's shoulder. The rear body panel straps are looped together and fed through a flexible rear adjustment plate which allows the two upper straps to make adjustments to the size of the child and forms a hand-hold at the upper end to support the child while the child is balancing itself to walk and give comfort and safety to the child and relief of back stress to the parent. The adjustment plate provides a separation of the holding straps to prevent closure of the straps around the child's head and neck. The adjustment plate is also provided with an aperture to allow a leash to be attached to it to control the movement of the child after the child is more advanced in walking.

9 Claims, 4 Drawing Sheets

CHILD WALKING HARNESS

Figure 1:
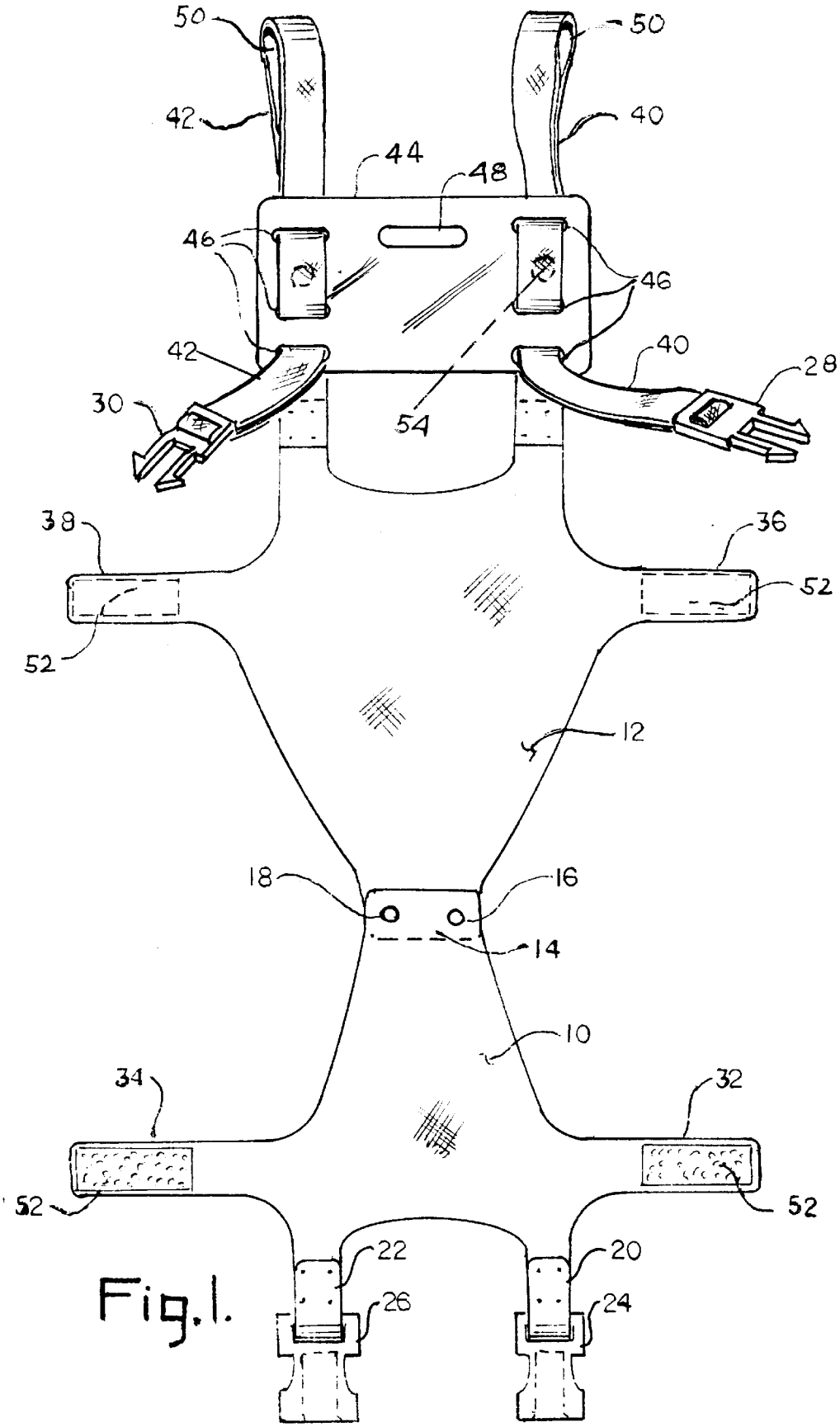

This invention relates to a new and unique method to enhance a child's progress in learning to walk.

OBJECT OF THE INVENTION

Most children at the age of 8–12 months try to crawl and then stand by themselves, holding onto furniture or other objects and often loose their balance and hurt themselves. Using the harness, as shown in accompanying drawings, will provide a simple elegant support that makes a baby's first steps safer. It gives the child confidence and balance with very little assistance from the parent. The child walking harness allows for non-restrictive range of motion during a child's early walking attempts by supporting their entire body weight evenly when needed to help cushion missteps and fills. The additional benefit of using the child walking harness is for the parent. The straps are ergonomically designed to minimize low back strain. The child walking harness is made of strong durable material with a soft fleece binding which allows for comfort around the child's arms, legs and crotch.

"Further objects and advantages of my invention will become apparent from the consideration of the drawings, photo pages and ensuing description."

BACKGROUND OF THE INVENTION

The use of restrainers or harnesses for children has been in use for many years and in many forms of applications. However, it was mainly to restrict a child's movement from an object, location, enclosure, or to restrict a child from running about. My invention relates to the safety of a child while a child or toddler is trying to walk and needs assistance. My invention provides for nonrestrictive movement of the child, but provides the toddlers' needed "training wheels".

DESCRIPTION OF RELATED ART

Kay, U.S. Pat. No. 4, 537,154 Shows an animal or child harness to enclose over a child or animal body. To hold a child or animal to a seat by means of a tether.

Hutchings U.S. Pat. No. 4,922,860 Shows a harness that is designed to support a child or person to be rehabilitated in walking. It fails to be safe for a toddler as the holding straps have to held apart to avoid closing of the straps to the head and neck of the child or person. Also, the connecting strap locks are located too close to the bearers neck and can cause injury and would not be suitable for toddlers or smaller children.

Herring, U.S. Pat. No. 5,676,426 Shows a harness that is basically designed to restrain a child to a chair or shopping cart seat.

Louks-Phillips U.S. Pat. No. 5,692,456 Shows a harness that is a combination of a bearer's vest with a strap arrangement to hold a child in front of the person.

Olaiz U.S. Pat. No. 5,927,235 Shows a child harness that encloses the chest portion of a more mature child and a tether attachment to prevent the child from running away.

Kohn U.S. Pat. No. 6,009,839 Shows a harness that can fit a carrier person and a connectable portion that can hold a child, similar to Louks/Phillips U.S. Pat. No. 5,692,456.

DRAWING REFERENCE NUMERALS WORKSHEET

Part Name
10 Front body panel
12 Rear body panel
14 Crotch connection
16 Snap button
18 Snap button
20 Front shoulder strap
22 Front shoulder strap
24 Releasable securing device
26 Releasable securing device
28 Releasable securing device
30 Releasable securing device
32 Panel extension
34 Panel extension
36 Panel extension
38 Panel extension
40 Holding strap
42 Holding strap
44 Adjustment plate
46 Aperture for holding strap
48 Aperture for restraining leash
52 Velcro pads
54 Rivet type fastener
56 Soft fleece binding
58 Spacing clip

SUMMARY

This invention is specifically designed to provide a safe comfortable and simple child walking harness to help a child to learn to walk and provide non restrictive range of motion, balance and support during the child's early walking attempts by supporting the entire body weight evenly when needed to help cushion missteps, falls and give additional benefit to the parent through the ergonomically designed holding straps to minimize low back pain and strain. The child walking harness also provides safety for children after they have learned to walk, especially in public places, around pools and beaches.

BRIEF DESCRIPTION OF THE DRAWINGS AND PHOTO PAGES

Drawing 1 of 2 in FIG. 1 shows a plan view and partial perspective (upper holding strap portion) of the child harness.

Figure 2:
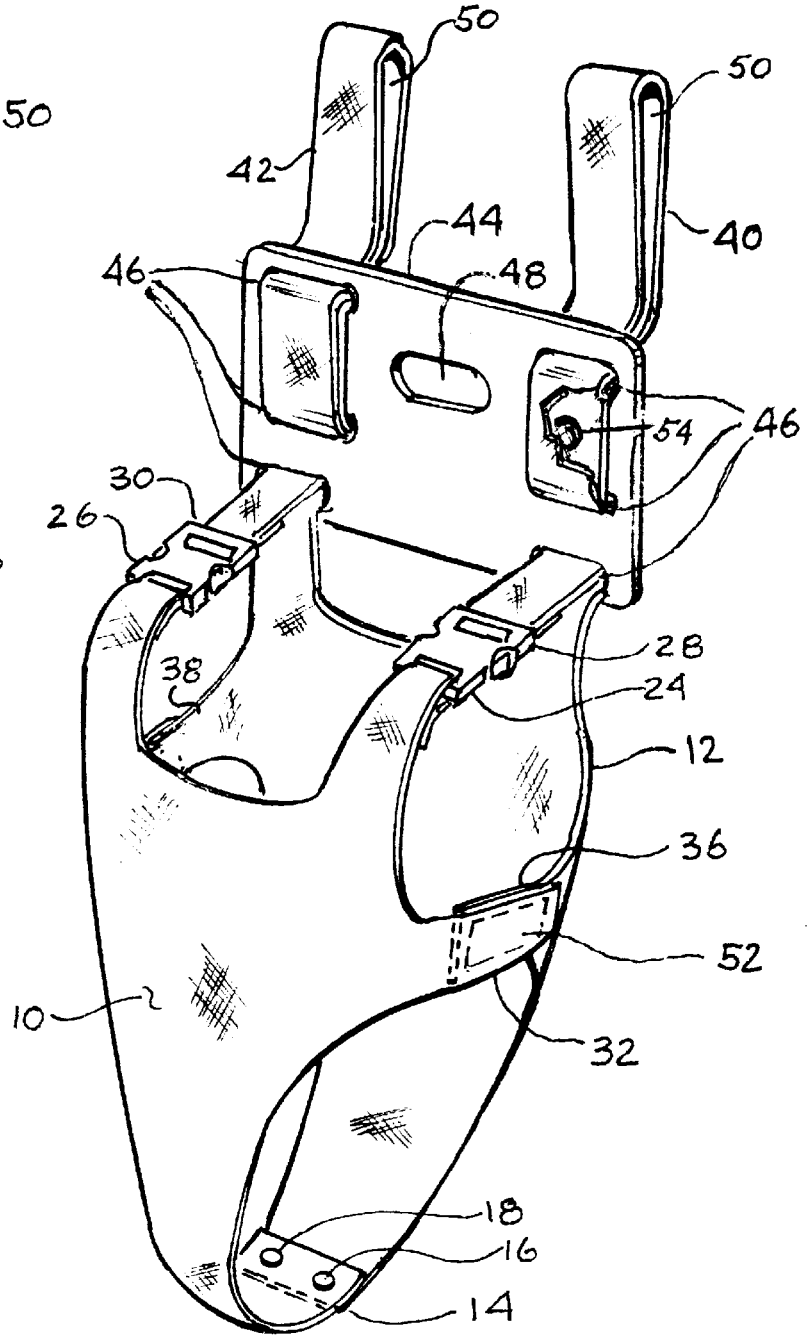

Drawing No. 2 FIG. 2 shows the harness in perspective view with all strap arrangements in locked position.

Figure 3:
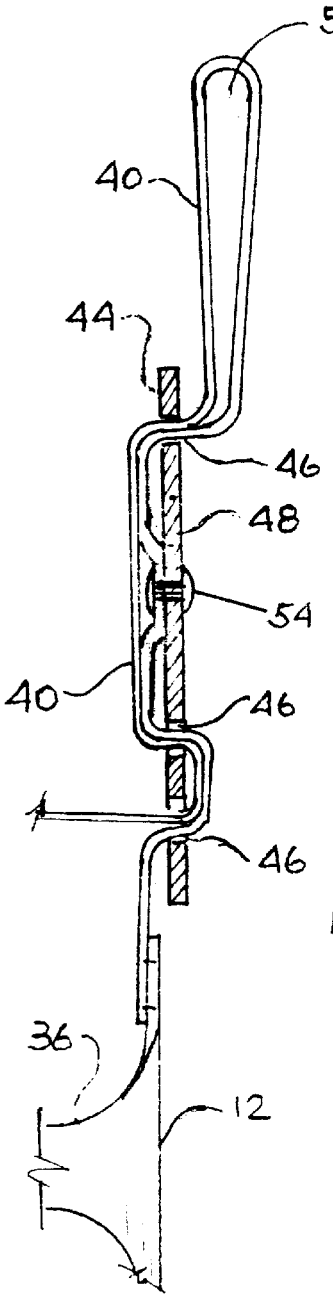

Drawing No. 2 FIG. 3 shows a sectional view of the adjustment plate with the holding straps looped in position.

Figure 4:
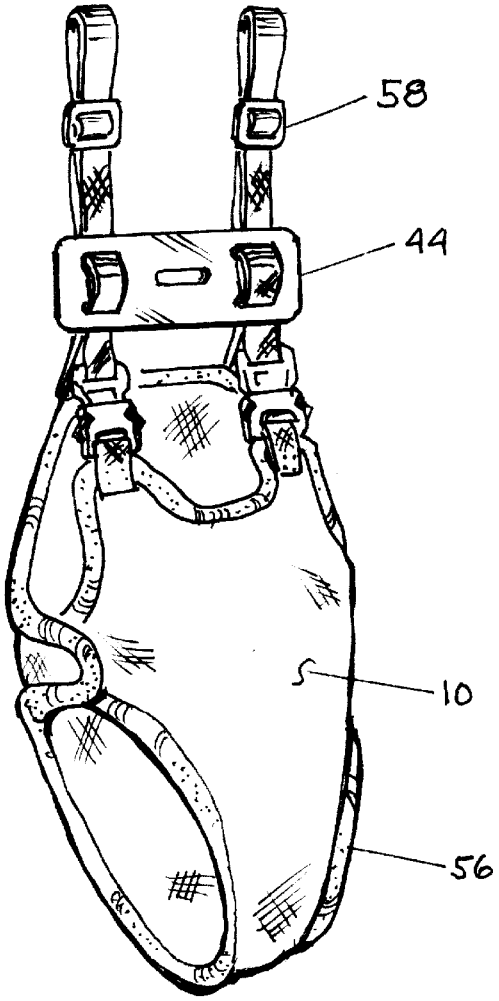
Figure 5:
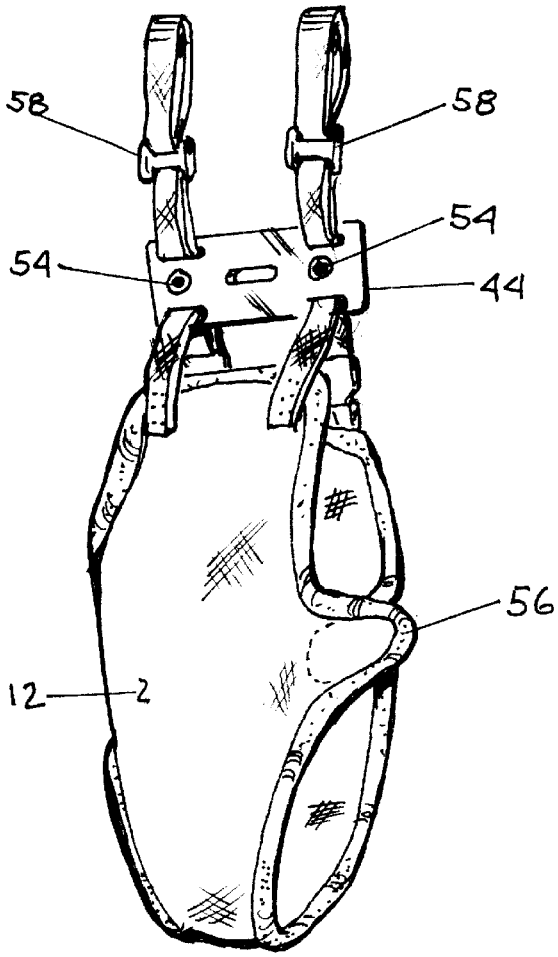

Drawing No. 3 FIG. 4 shows the front view of the walking harness and FIG. 5 shows the rear view of the walking harness.

Figure 6:
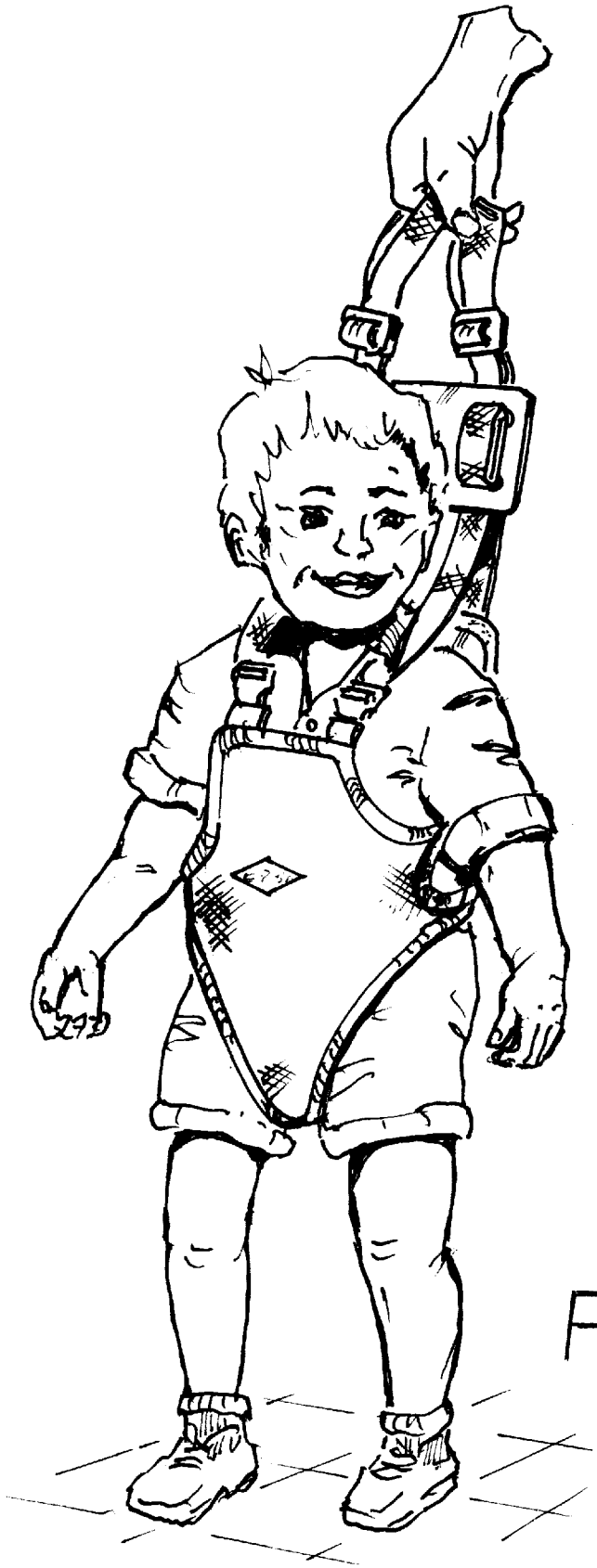

Drawing No. 4 FIG. 6 shows the child walking harness being used.

With reference to the drawings No. 1 of 2 shows in FIG. 1 the harness in plan and partial perspective view indicating a front body panel 10 and a rear body panel 12 connected at the lower body crotch 14 between the child's legs with snap buttons 16 and 18 to provide a quick release of the panel for changing diapers without removing the harness. The front body panel 10 is fitted with two lock straps 20 and 22 are provided and releasable securing devices 24 and 26 a respectively which will fit to first counterpart 28 and 30 at the rear body panel 12 and the holding straps 40 and 42.

Both body panels 10 and 12 are fitted with panel extensions 32 and 34 and 36 and 38 respectively and are provided with and fitted with velcro pads 52 to lock together around the child's upper torso. The rear body straps 40 and 42 are fitted with releasable securing devices 28 and 30 and the strap is looped together and fitted through and adjustment plate 44 and two sets of apertures 46 to form holding loops 50 and 52 to form a handhold for the child's support and to adjust the straps to various sizes of children. The adjustment plate 44 is made of strong but flexible material like plastic or leather, but strong enough to separate the holding straps 40 and 42 and prevent the closure over the child's neck.

The front body panel 10 and rear body 12 are made of strong flexible material such as canvas or webbing cloth and enclose a substantial part of the child's body to ensure safety to the child. A separate aperture 48 is provided to the adjustment plate 44 to allow for a walking leash to fasten to it, to restrain a child after a child is more advanced in walking. Drawing number 2 FIG. 3 shows a sectional view of the adjustment plate 44 with the holding straps 40 and 42 in which the rear leg or strand of the holding strap 40 and 42 are secured to the adjustment plate 44 by means of a rivet type fastener 52 to prevent the adjustment plate 44 to slide up on the holding straps 40 and 42 to provide adjustment only by the front strap.

Photo page 1 of 2, FIG. 4 shows the child walking harness in its' manufactured form showing the soft fleece binding 56 fitted around all exposed edges of the front and back body panels 10 and 12. providing comfort around the child's arms, legs and crotch.

Photo page 1 of 2, FIG. 5 showing a rivet type fastener 54 and also shows the positive separation of the two holding straps 40 and 42 at the adjustment plate 44 preventing the straps 40 and 42 to enclose on the child's neck and head.

Photo page 2 of 2, shows the child walking harness being used.

OPERATION OF THE CHILD WALKING HARNESS

The center or crotch portion 14 is lead through the child's legs. Front panel 10 is brought up on the child's chest and the rear body panel 12 is brought up to the child's shoulder, front shoulder strap 20 and 22 is then connected to the rear holding strap 40 and 42 by means of releasable securing device 24 and 28 and 26 and 30. Front panel extensions 32 and 34 are connected to rear panel extension 36 and 38 enclosing the child's upper torso and locked together with velcro pads 52 the shoulder straps 40 and 42 are then adjusted to the child's shoulder and locked for a comfortable fit.

The following is claimed:

1. A child walking harness comprising:

an upright oriented elongated front body panel having a top end, a bottom end, a left edge and a right edge; a left front shoulder strap having a front end and a right front shoulder strap having a front end are laterally spaced from each other and they extend upwardly from said top end of said front body panel;

an upright oriented elongated rear body panel having a top end, a bottom end, a left edge and a right edge;

said bottom ends of said front body panel and said rear body panel being connected to each other;

an elongated left side holding strap having a first end and a second end and said first end is connected to said top end of said rear body panel;

an elongated right side holding strap having a first end and a second end and said first end is connected to said top end of said rear body panel;

said respective first ends of said left side holding strap and said right side holding strap being laterally spaced from each other;

a transversely extending elongated adjustment plate having a front surface, a rear surface, a top edge, a bottom edge, a left edge and a right edge; a first upper slot and a first lower slot are formed in said adjustment plate adjacent said left edge; said first upper slot and first lower slot are vertically spaced from each other; a second upper slot and second lower slot are formed in said adjustment plate adjacent said right edge; said second upper slot and said second lower slot are vertically spaced from each other;

said second end of said left side holding strap is fed from said rear surface of said adjustment plate through said first lower slot and then fed from said front surface of said adjustment plate through said first upper slot; the portion of said left side holding strap between said first lower slot and said first upper slot is securely fastened to said adjustment plate so that the distance between said top edge of said rear body panel and said bottom edge of said adjustment plate cannot be adjusted; after exiting said first upper slot said second end of said left side holding strap is extended a sufficient distance and then folded back upon itself to form a holding loop after which said second end of said left side holding strap is fed from said rear surface of said adjustment plate through said first upper slot and then fed from said front surface of said adjustment plate through said first lower slot;

said second end of said right side holding strap is fed from said rear surface of said adjustment plate through said second lower slot and then fed from said front surface of said adjustment plate through said second upper slot; the portion of said right side holding strap between said second lower slot and said second upper slot is securely fastened to said adjustment plate so that the distance between said top edge of said rear body panel and said bottom edge of said adjustment plate cannot be adjusted; after exiting said second upper slot said second end of said right side holding strap is extended a sufficient distance and then folded back upon itself to form a holding loop after which said second end of said right side holding strap is fed from rear surface of said adjustment plate through said second upper slot and then fed from said front surface of said adjustment plate through said second lower slot; and means detachably connecting said second ends of said respective left and right side holding straps to said respective first ends of said left side and right side shoulder straps.

2. A child walking harness as recited in claim 1 further comprising means for detachably connecting said left edge of said front body panel to said left edge of said rear body panel; and means for detachably connecting said right edge of said front body panel to said right edge of said rear body panel.

3. A child walking harness as recited in claim 1 wherein said bottom ends of said front body panel and said rear body panel are detachably connected to each other allowing separation of said panels thus providing access to change a child's diaper without removing the entire harness.

4. A child walking harness as recited in claim 1 wherein said front and rear panels are made of durable water repellant and mildew resistant material.

5. A child walking harness as recited in claim 1 wherein said adjustment plate is made of plastic material.

6. A child walking harness as recited in claim 1 wherein said adjustment plate is made of leather material.

7. A child walking harness as recited in claim 1 wherein said adjustment plate has an aperture in its central area for attachment of a tether line to restrain a child in it's later walking stage.

8. A child walking harness as recited in claim 1 wherein said holding straps are made of nylon webbing material.

9. A child walking harness as recited in claim 1 wherein said holding loops of said respective left and right side holding straps are provided with spacing clips that insure said loops being shortened enough to prevent either of said loops from fitting over a child's head.

* * * * *